US011228826B2

(12) United States Patent
Ha et al.

(10) Patent No.: US 11,228,826 B2
(45) Date of Patent: Jan. 18, 2022

(54) DISPLAY APPARATUS

(71) Applicant: LG Display Co., Ltd., Seoul (KR)

(72) Inventors: GyungBo Ha, Paju-si (KR); HakMo Hwang, Paju-si (KR); Taehyung Kim, Paju-si (KR); Seeun Kim, Paju-si (KR); Seung Jun Koo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/921,183

(22) Filed: Jul. 6, 2020

(65) Prior Publication Data

US 2021/0014590 A1 Jan. 14, 2021

(30) Foreign Application Priority Data

Jul. 8, 2019 (KR) ..... 10-2019-0081990

(51) Int. Cl.

| | |
|---|---|
| ***H04R 1/02*** | (2006.01) |
| ***H04R 1/28*** | (2006.01) |
| ***H04R 9/02*** | (2006.01) |
| ***H04R 9/06*** | (2006.01) |
| *H04R 9/00* | (2006.01) |

(52) U.S. Cl.

CPC ..... *H04R 1/028* (2013.01); *H04R 1/2811* (2013.01); *H04R 9/022* (2013.01); *H04R 9/025* (2013.01); *H04R 9/06* (2013.01); *H04R 2499/15* (2013.01)

(58) Field of Classification Search

CPC ..... H04R 1/028; H04R 1/2811; H04R 9/022; H04R 9/025; H04R 9/06; H04R 2499/15

USPC ..... 381/333, 334

See application file for complete search history.

(56) References Cited

U.S. PATENT DOCUMENTS

2007/0274556 A1* 11/2007 Matsumura ..... H04R 1/22 381/412
2014/0270303 A1* 9/2014 Cheng ..... G06F 1/16 381/333
2015/0304760 A1* 10/2015 Yeh ..... H04R 1/1091 381/370
2016/0050472 A1 2/2016 Lee et al.
2017/0280215 A1 9/2017 Lee et al.

(Continued)

FOREIGN PATENT DOCUMENTS

CN 108271103 A 7/2018
JP H11-215585 A 8/1999

(Continued)

OTHER PUBLICATIONS

Search report issued in corresponding European patent application No. 20184287 dated Oct. 11, 2020.

(Continued)

*Primary Examiner* — Ammar T Hamid

(74) *Attorney, Agent, or Firm* — Morgan, Lewis & Bockius LLP

(57) ABSTRACT

The present disclosure relates to a display apparatus, especially having a display panel generating sounds. A display apparatus according to the present disclosure includes: a display module; a back cover at a rear surface of the display module; a compartment provided inside the back cover; a fixing element provided inside the compartment; a sound generating unit inserted into the compartment and installed by the fixing element; and an adhesive element attaching an upper surface of the sound generating unit and the rear surface of the display module.

16 Claims, 5 Drawing Sheets

(56) References Cited

U.S. PATENT DOCUMENTS

| | | | | |
|---|---|---|---|---|
| 2017/0289694 | A1 | 10/2017 | Choi et al. | |
| 2018/0317012 | A1 | 11/2018 | Lee et al. | |
| 2019/0050024 | A1* | 2/2019 | Ahn | H04N 5/642 |
| 2019/0052963 | A1 | 2/2019 | Choi et al. | |
| 2019/0103521 | A1 | 4/2019 | Umehara et al. | |

FOREIGN PATENT DOCUMENTS

| | | | |
|---|---|---|---|
| JP | 3070553 | U | 8/2000 |
| JP | 2003-211087 | A | 7/2003 |
| JP | 2017-187734 | A | 10/2017 |
| JP | 2017-194975 | A | 10/2017 |
| JP | 2018-093468 | A | 6/2018 |
| JP | 2018-110369 | A | 7/2018 |

OTHER PUBLICATIONS

"Tech Note: Understanding Exciters-Principles and Applications", Apr. 18, 2014, pp. 1-8.

Japanese Office Action dated Jun. 1, 2021, issued in corresponding Japanese Patent Application No. 2020-116947.

Office Action issued in corresponding Chinese Patent Application No. 202010610523.3, dated Jul. 5, 2021.

* cited by examiner

DISPLAY APPARATUS

CROSS-REFERENCE TO RELATED APPLICATIONS

This application claims the benefit of the Korean Patent Application No. 10-2019-0081990 filed on Jul. 8, 2019, which is hereby incorporated by reference as if fully set forth herein.

BACKGROUND

Technical Field

The present disclosure relates to a display apparatus, especially having a display panel generating sounds.

Discussion of the Related Art

In general, the display apparatus is used as a screen to display visual information such as a television, a monitor, a laptop computer, a smart phone, a tablet computer, an electronic pad wearable device, a watch phone, a portable information device, a navigation system or an electronic products, a vehicle control display device or the home appliances.

A general display apparatus may include a display panel for representing a video image, and an audio device for providing sounds related to the video image.

However, the conventional display apparatus has a limitation in which sound quality deteriorates due to interference between sounds reflected from a wall or the floor because the sounds output from the sound device proceed to the rear or bottom side of the display panel. Therefore, it is difficult to accurately provide the sound to the viewers, so that the immersion of viewers may be deteriorated.

SUMMARY

The inventors of the present disclosure recognized problems with a related display apparatus and conducted various experiments to improve the sound quality and to provide the sound to the front direction of the display panel when viewers see an image in front of the display panel. After a number of experiments, the inventors can provide a display apparatus having a new structure capable of generating sounds that can proceed in front of the display panel and improving the sound quality.

Accordingly, embodiments of the present disclosure are directed to a display apparatus that substantially obviates one or more of the problems due to limitations and disadvantages of the related art.

An aspect of the present disclosure is to provide a display apparatus accurately suggesting sounds. Another aspect of the present disclosure is to provide a display apparatus generating sounds proceeding to the front direction of the display panel.

Still another aspect of the present disclosure is to provide a display apparatus improving the sound quality and increasing viewer immersion. A further aspect of the present disclosure is to provide a sound generating unit constructed in a modular type and to provide a display apparatus having a structure that may be mounted in a back cover in a simple assembly process.

Yet another aspect of the present disclosure is to provide a display apparatus having a modular sound generating unit that may provide improved sound quality, can easily mount any additional elements ensuring a rich sound volume and quality, and may be easy to repair and replace.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display apparatus comprises: a display module; a back cover disposed at a rear surface of the display module; a compartment provided inside the back cover; a fixing element provided inside the compartment; a sound generating unit inserted into the compartment and installed by the fixing element; and an adhesive element attaching an upper surface of the sound generating unit and the rear surface of the display module.

In one embodiment, the back cover includes: an upper substrate facing to the rear surface of the display module; a lower substrate apart from the upper substrate with a predetermined distance; and a plurality of partition walls disposed between the upper substrate and the lower substrate. The compartment is divided by the partition walls into a plurality of the compartments.

In one embodiment, the sound generating unit is inserted into the compartment from a top surface of the compartment, and a bottom surface of the compartment is joined with bottom of the sound generating unit by the fixing element.

In one embodiment, the sound generating unit include: a unit housing; and a vibration unit mounted inside the unit housing. An upper surface of the vibration unit is attached to the rear surface of the display module by the adhesive element.

In one embodiment, the display apparatus further comprises: a resonance path connecting an inner space of the unit housing and the compartment.

In one embodiment, the display apparatus further comprises: a weight element attached inside the unit housing.

In one embodiment, the adhesive element is deposited overall of the rear surface of the display module. An upper surface of the unit housing, an upper surface of the vibration unit and a top surface of the upper substrate of the back cover are attached to the display module by the adhesive element.

In one embodiment, an upper surface of the unit housing is disposed at a same level with or at higher level from an upper surface of the upper substrate. The adhesive element is deposited on the upper surface of the unit housing and the upper surface of the vibration unit.

In another aspect, a display apparatus comprises: a sound generating unit including a vibration unit installed in a unit housing; a back cover including a compartment where the sound generating unit is inserted, and a fixing element provided inside the compartment for installing the sound generating unit; and a display module disposed at a top surface of the back cover and attached to an upper surface of the vibration unit.

In one embodiment, the display module includes: a display panel including a display area and a non-display area surrounding the display area; a functional film disposed at an outer upper surface of the display panel; and a heat dissipate element disposed at a rear surface of the display panel. The display apparatus further comprises: an adhesive element attaching the upper surface of the vibration unit to the heat dissipate element.

In one embodiment, the display apparatus further comprises: a guide panel surrounding sides of the back cover and the display module, and assembling the back cover with the display module.

In one embodiment, the sound generating unit further includes: a weight element installed at circumference of the vibration unit inside the unit housing.

In one embodiment, the unit housing includes: a bottom surface; a top surface facing the bottom surface and having an aperture; and a side surface connecting the bottom surface and the top surface. The sound generating unit is installed on the bottom surface by the fixing element.

In one embodiment, the unit housing further includes: a resonance opening formed at one portion of the side surface for exposing an inner space of the unit housing.

In one embodiment, the vibration unit includes: a base plate having vessel shape and fixed inside the unit housing; a magnet having a cylindrical shape and fixed at a center portion of the base plate; a bobbin apart from the magnet and surrounding the magnet; a coil surrounding the outer circumference of the bobbin; a bobbin protector attached at the upper portion of the bobbin; and a damper connecting at least one of the bobbin and the bonnin protector to the base plate. An upper surface of the bobbin protector is attached to the display module. The emission area includes the plurality of aperture areas defined by the bank.

In one embodiment, the back cover includes: an upper substrate; a lower substrate facing the upper substrate with a predetermined distance; a plurality of partition walls disposed between the upper substrate and the lower substrate; and a plurality of compartments surrounded by the partition walls. The sound generating unit inserted in the compartment through a mounting hole formed by removing some of the upper substrate and installed at the lower substrate.

In one embodiment, the compartment have any one shape, in a plan view, of a square, a rectangle, a regular hexagon, a regular octagon, a circle and an oval.

In one embodiment, the display apparatus further comprises: a resonance path connecting an inner space of the unit housing and a space of the compartment.

According to an example of the present disclosure, it is possible to provide a display apparatus accurately generating and transmitting the sounds, improving the sound quality, and increasing immersion of viewers. According to another example of the present disclosure, it is possible to provide a display apparatus generating sounds to the front of the display panel. In particular, as the back cover attached to the rear surface of the display module may include compartment formed between two substrate, the back cover may have a light weight and a strengthen structure. In addition, the sound generating unit may be inserted into the compartment formed by the partition walls, so that the present disclosure may provide a display apparatus with a built-in speaker function without increasing thickness of the flat display apparatus.

In addition, as further comprising a weight element to the sound generating unit inserted into the back cover, the elevation movement of the bobbin generating the vibration may be ensured. As further comprising a resonance path connecting the space formed by the sound generating unit and the space formed by the compartment, a high quality sound may be provided.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION OF THE DISCLOSURE

Figure 1:
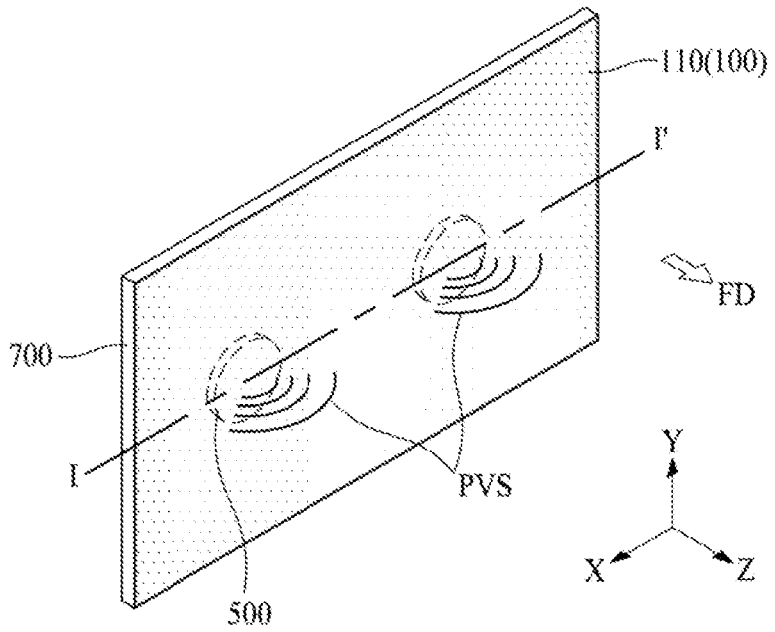
FIG. 1 is a diagram illustrating a display apparatus having a sound generating unit at the rear surface according to the present disclosure.

Reference will now be made in detail to the exemplary embodiments of the present disclosure, examples of which are illustrated in the accompanying drawings. Wherever possible, the same reference numbers will be used throughout the drawings to refer to the same or like parts. In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows. Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In the case that "comprise," "have," and "include" described in the present specification are used, another part may also be present unless "only" is used. The terms in a singular form may include plural forms unless noted to the contrary.

In construing an element, the element is construed as including an error range although there is no explicit description.

In describing a positional relationship, for example, when the positional order is described as "on," "above," "below," and "next," the case of no contact there-between may be included, unless "just" or "direct" is used. If it is mentioned that a first element is positioned "on" a second element, it does not mean that the first element is essentially positioned above the second element in the figure. The upper part and the lower part of an object concerned may be changed depending on the orientation of the object. Consequently, the case in which a first element is positioned "on" a second element includes the case in which the first element is positioned "below" the second element as well as the case in which the first element is positioned "above" the second element in the figure or in an actual configuration.

In describing a temporal relationship, for example, when the temporal order is described as "after," "subsequent," "next," and "before," a case which is not continuous may be included, unless "just" or "direct" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as the first, the second, A, B, (a) and (b) may be used. These terms are only to distinguish the elements from other elements, and the terms are not limited in nature, order, sequence or number of the elements. When an element is described as being "linked", "coupled" or "connected" to another element that element may be directly connected to or connected to that other element, but indirectly unless otherwise specified. It is to be understood that other elements may be "interposed" between each element that may be connected to or coupled to.

It should be understood that the term "at least one" includes all combinations related with any one item. For example, "at least one among a first element, a second element and a third element" may include all combinations of two or more elements selected from the first, second and third elements as well as each element of the first, second and third elements.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in a co-dependent relationship.

The 'display apparatus' in this application may comprise a liquid crystal module (LCM), an organic light emitting display module (OLED Module), or a quantum dot module (QD Module) which are have a display panel and a driver for driving the display panel. The 'display apparatus' may further comprise a complete product or final product including LCM, OLED Module or QD Module such as a notebook computer, a television set, a computer monitor, an equipment apparatus having an automotive apparatus or other modules for vehicle, a set electronic apparatus or a set device (or set apparatus) such as a smart phone or a mobile electronic apparatus.

Therefore, the 'display apparatus' may be any one of a display device such as LCM, OLED Module and QD Module, an application device including LCM, OLED Module or QD Module, or a set apparatus for end user's final devices.

In another example, the LCM, OLED Module or QD Module may be referred to the 'display apparatus', and the final electronic devices including LCM, OLED Module or QD Module may be referred to the 'set apparatus'. For example, the display apparatus may include a display panel of liquid crystal display or organic electroluminescence display, and a source printed circuit board (PCB) for driving the display panel. The set apparatus may include the display apparatus and a set PCB or control PCB for driving the set apparatus itself by connecting to the display apparatus and the source PCB.

The display panel according to the embodiments of the present disclosure may include a liquid crystal display panel, an organic light emitting diode display panel, and an electroluminescent display panel, but it is not limited thereto. For example, display panel may have any structure in which the display panel may be vibrated to generate sound. In addition, the display panel applied to the display apparatus according to the embodiment of the present disclosure is not limited to the shape or size of the display panel.

In the case that the display panel is the liquid crystal display panel, the display panel may include a plurality of gate lines, a plurality of data lines, and a plurality of pixels (or sub pixels) defined by the gate lines and the data lines. The display panel may include an array substrate including thin film transistor as a switching element for controlling the light transmittance of each pixel, an upper substrate including a color filter and/or a black matrix, and a liquid crystal layer disposed between the array substrate and the upper substrate.

In the case that the display panel is an organic light emitting diode display panel, the display panel may include a plurality of gate lines, a plurality of data lines, and a plurality of pixels (or sub pixels) defined by the gate lines and the data lines. The display panel may include an array substrate including thin film transistor for applying the electric voltage to each pixel selectively, an organic light emitting layer on the array substrate, and an encapsulation substrate disposed on the array substrate for covering the organic light emitting layer. The encapsulation substrate may protect the thin film transistor and the organic light emitting layer from any external shocks, and prevent moisture and oxygen from penetrating into the organic light emitting layer. In addition, the organic light emitting layer formed on the array substrate may be replaced by the inorganic light emitting layer, the quantum dot light emitting layer, or the micro light emitting diode element.

The display apparatus including the sound generating module according to the present disclosure may be applied to the vehicle as the user interface module such as the central control panel in the automobile. For example, the display panel may be installed at the center fascia between the driver seat and the assistant seat so that the vibration of the display panel propagates toward the interior space of the vehicle. Therefore, the in-car audio can be improved compared to having conventional speakers only at inside sides of the car.

Hereinafter, an example of a display apparatus according to the present disclosure will be described in detail with reference to the accompanying drawings. In designating reference numerals to elements of each drawing, the same components may have the same reference numerals as much as possible even though they are shown in different drawings. Scale of the elements shown in the accompanying drawings have a different scale from the actual for convenience of description, it is not limited to the scale shown in the drawings.

FIG. 1 is a diagram illustrating a display apparatus having a sound generating unit at the rear side according to the present disclosure. Referring to FIG. 1, the display apparatus according to the present disclosure may output acoustics or sounds PVS in accordance with vibration of a display module 100 for representing image data. For example, in a display apparatus, the display module 100 may be vibrated by the sound generating unit 500 to output sounds PVS. Most of the sounds PVS generated by the vibration of the display module 100 may be directly output toward the front of the screen FD of the display apparatus. The display apparatus according to the present disclosure can use the display module 100 as a diaphragm for generating sounds PVS and outputting the sounds PVS to the front of the screen FD of the display module 100. Accordingly, the sounds can be accurately transmitted to the viewers and the sound quality can be improved, and the immersion of viewers can be enhanced.

In the display apparatus according to the present disclosure, the sound generating unit 500 provides vibration forces to the display module 100, and the display module 100 vibrates to make sound. The display module 100 may be formed of a substrate easily vibrated such as a large area glass substrate, and may include a back cover for supporting the display module 100 on the rear surface of the display apparatus. Installing the vibration generating device to the rear surface of the display module 100 by replacing with the speaker used in the related arts, the present disclosure may provide a structure for maintaining the thickness of the whole display apparatus including the display module 100 in a very thin thickness. Hereinafter, referring to figures, various embodiments of the present disclosure will be described in detail.

First Embodiment

Figure 2:
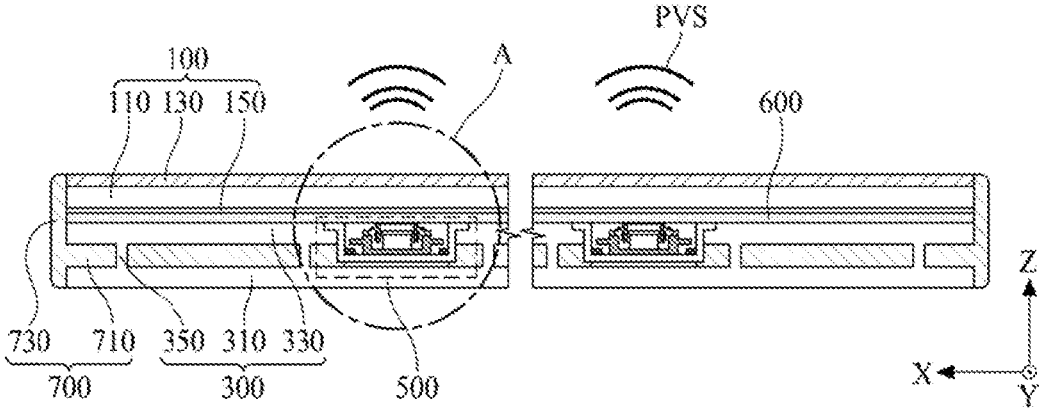
FIG. 2 is a cross-sectional view, cutting along I-I' in FIG. 1, illustrating a structure of the display apparatus according to the first embodiment of the present disclosure.
Figure 3:
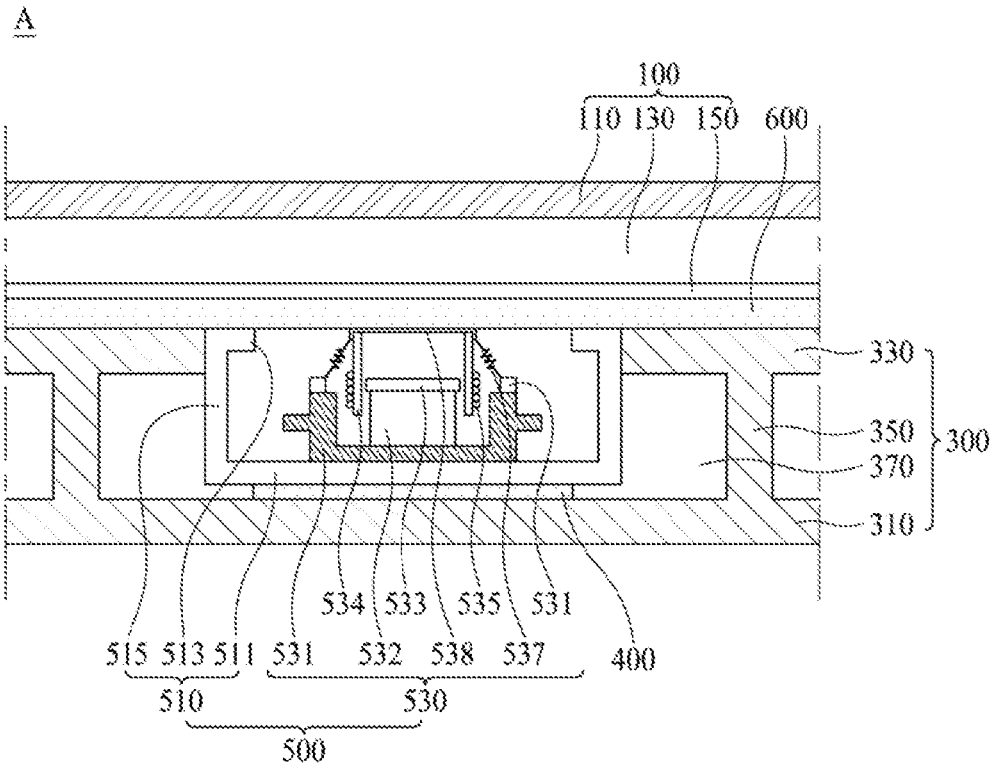
FIG. 3 is an enlarged cross-sectional view of circled portion of FIG. 2, illustrating a structure of vibration generating unit in the display apparatus according to the first embodiment of the present disclosure.

FIG. 2 is a cross-sectional view, cutting along I-I' in FIG. 1, illustrating a structure of the display apparatus according to the first embodiment of the present disclosure. FIG. 3 is an enlarged cross-sectional view of circled portion of FIG. 2, illustrating a structure of vibration generating unit in the display apparatus according to the first embodiment of the present disclosure.

Referring to FIG. 2, the display apparatus according to the first embodiment of the present disclosure may comprise a display module 100, a back cover 300 and a sound generating unit 500. The sound generating unit 500 may have a structure of being inserted and fixed into the back cover 300.

The display module 100 may include a display panel 110, a functional film 130 and a heat diffusion element 150. The display panel 110 may be implemented as various types of the display. The display panel 110 may vibrate in response to the vibration of the sound generating unit 500 to directly output the sounds PVS to the front direction FD. For example, when display module 100 plays role for generating the sounds PVS, the display module 100 may be a diaphragm, a panel speaker or a flat speaker that directly generates the sounds PVS.

In one example, the display panel 110 may include a pixel circuit disposed on a substrate (or base substrate), and a pixel array layer (or display unit) connected to the pixel circuit and having an anode electrode, a cathode electrode and an organic emission layer. The display panel 110 may display an image in a top emission type, a bottom emission type or a dual emission type according to the structure of the pixel array layer. The anode electrode may be expressed as a first electrode or a pixel electrode, but it is not limited to this term. The cathode electrode may be expressed as a second electrode or a common electrode, but it is not limited to this term.

The functional film 130 may include an anti-reflection layer (or anti-reflective film) for preventing ambient light reflection and improving outdoor visibility and contrast ratio for an image displayed on the display panel 110. For example, the anti-reflection layer may be a circular polarized layer (or circular polarization film) that prevents reflected light from being reflected by thin film transistors and/or lines disposed at the pixel array layer of the display panel 1100 to the viewers. Although not shown in figures, the functional film 130 may be attached on the display panel 110 using a transparent adhesive layer.

In one example, the functional film 130 may further include a light path control layer (or an optical film) that adjusts a path of light emitted from the pixel array layer of the display panel 110 toward viewers. The light path control layer may include a structure in which a high refractive layer and a low refractive layer are alternately stacked, thereby the path of light incident from the pixel array layer may be changed to minimize the color shift phenomena according to the viewing angle. In this case, the low refractive layer may be disposed at the topmost layer of the light path control layer.

In one example, the display module 100 may further include a touch electrode unit for user interface using a user's touch. The touch electrode unit may be inserted between the display panel 110 and the functional film 130 or embedded into the display panel 110 for the in-cell touch type. For example of the in-cell touch type, the touch electrode unit may include the touch electrodes of the mutual capacitance type or the self-capacitance type.

The heat diffusion element 150 may have a thin sheet shape adhered to the whole rear surface of the display panel 110. The heat diffusion element 150 may be disposed on the rear surface of the display module 100 so as to overlap with the sound generating unit 500, thereby the heat generated when the sound generating unit 500 is operated may be diffused toward the display module 100. Accordingly the performance degradation of the sound generating unit 500 caused by the heat can be prevented. In addition, the heat diffusion element 150 may have a size corresponding to the whole rear surface of the display panel 110 to diffuse the heat generated, when the sound generating unit 500 is operated, to the wider areas. Accordingly, it is possible to prevent the heat from being intensively concentrated to a local area of the display module 100 overlapping with the sound generating unit 500, thereby the local luminance non-uniformity of the display module 100 can be minimized or prevented.

For example, the heat diffusion element 150 may include a material having high thermal conductivity such as any one material of aluminum (Al), copper (Cu), silver (Ag) and magnesium (Mg) or an alloy of them, but it is not limited thereto.

The back cover 300 may be disposed on the rear surface of the display module 100. The back cover 300 may mount or fix the sound generating unit 500 therein.

In one example, the back cover 300 may cover the rear surface of the display module 100. The back cover 300 may be expressed as a supporting member, a housing, a system cover, a set cover, a rear cover, a cover bottom, a back frame, or chassis, but it is not limited thereto. The rear surface of the display module 100 may be expressed as one side, a first side, a back surface or a lower surface, but it is not limited thereto.

The back cover 300 may be attached to the rear surface of the display module 100 with an adhesive element 600. The adhesive element 600 may include a pressure sensitive adhesive (PSA), an optical clear adhesive (OCA) or an optical clear resin (OCR), but it is not limited thereto. Attached with whole of the rear surface of the display module 100, the back cover 300 may function for protecting the rear surface of the display module 100 from any external shocks and for dissipating the heat generated from the display module 100.

In one example, the back cover 300 may have a plate shape covering the whole rear surface of the display module 100, i.e., the entire rear surface of the heat diffusion element 150. In some examples, the edge portions or the corner portions of the back cover 300 may have a sloped shape or a curved shape by chamfering or rounding process.

Hereinafter, further referring to FIG. 3, the back cover 300 will be explained in detail. Referring to FIGS. 2 and 3, the back cover 300 may include a lower substrate 310, an upper substrate 330, a partition wall 350 and a compartment 370. The back cover 300 may further include a fixing element 400 for installing the sound generating unit 500, on a surface portion of the lower substrate 310 forming the compartment 370.

The lower substrate 310 may have a thin plate structure. The upper substrate 330 may be facing and joined with the lower substrate 310 with a predetermined distance. A plurality of partitions 350 may be inserted between the lower substrate 310 and the upper substrate 330, to keep the gap between the lower substrate 310 and the upper substrate 330 in constant. The plurality of partition walls 350 may be arranged by connecting each other on the lower substrate 310, so that the compartment 370 may be arranged to have a planar shape such as a square, a rectangle, a regular hexagon, a regular octagon, a rhombus, a circle, and oval or an irregular polygon on the top view.

By providing a defined compartment 370 surrounded by the partition walls 350 between the lower substrate 310 and the upper substrate 330 as described above, it is possible to accomplish a structure enhancing the strength and reducing the weight of the back cover 300. As the size of the compartment 370 is reduced, the weight of the back cover 300 increases, but the rigidity may be maintained more strongly. As the size of the compartment 370 is increased, the weight of the back cover 300 decreases, but the rigidity may be slightly weakened. Considering this trade-off relationship, the thickness of the partition wall 350 and/or the space size of the compartment 370 may be appropriately set in accordance with the size and required rigidity of the display panel.

The present disclosure provides a structural feature to mount the sound generating unit 500 inside the compartment 370. Therefore, it is preferable that the size of the compartment 370 has a sufficient surface area and/or volume to contain the sound generating unit 500. However, when it is necessary to increase the rigidity of the back cover 300, the size of the compartment 370 may be designed to be much smaller than the sound generating unit 500. For example, there may be a case in which the size of the partition wall 370 is reduced and the thickness of the partition wall 350 is thickened or the number of the partition walls 350 is increased. In this case, only a few compartments 370 corresponding to the number of sound generating units 500 may have a size sufficient to mount the sound generating units 500, and the rest of the compartments 370 may be set to a small size for ensuring the rigidity.

Further, referring to FIG. 3, the structure of the sound generating unit 500 and the arrangement relationship fixed inside the back cover 500 will be described in detail.

The sound generating unit 500 may include a unit housing 510 and a vibration unit 530. The vibration unit 530 may be fixed inner space of the unit housing 510. Therefore, the unit housing 510 may have sufficient volume for enclosing or mounting the vibration unit 530.

The unit housing 510 may include a bottom surface 511, a top surface 513 and a side surface 515. The bottom surface 511 may be a bottom plate of the unit housing 510 for fixing or installing the vibration unit 530 thereon. In addition, the bottom surface 511 may be fixed inside the back cover 300. The top surface 513 may be a top plate facing the bottom surface 511 with a predetermined distance. The top surface 513 may have an aperture. Through this aperture, the vibration unit 530 may be installed on or disassembled from the bottom surface 511. The side surface 515 may be a side plate for connecting the bottom surface 511 and the top surface 513 for protecting the inner space of the unit housing 510.

The unit housing 510 may be made of various materials. After making the bottom surface 511, the top surface 513 and the side surface 515 respectively, they are assembled each other. Otherwise, using a mold, the unit housing 510 may be imprinted as a vessel having a "U" shape. In FIG. 3, the aperture formed at the top surface 513 has a smaller area than the area of the top surface 513, but it is not limited thereto. In other case, the aperture may be same area with the top surface 513. Further, the top surface 513 may be extruded outward from the side surface 515 as shown in FIG. 2, or the top surface 513 may be extruded innerward from the side surface 515 as shown in FIG. 3.

The vibration unit 530 is a mechanical body that actually generates the acoustic vibration. The vibration unit 530 may be installed inside the unit housing 510 to vibrate the display module 100. The vibration unit 530 may be fixed to the unit housing 510 using a fixing element or made as one body with the unit housing 510. Even though not shown in figures, the fixing element may be an organic adhesive such as epoxy bond or a mechanical element such as a screw or hook.

The vibration unit 530 may include any type of sound devices or vibration generating device for vibrating the display module 100 in response to the electrical signal. For example, the vibration unit 530 may be configured to vibrate the display module 100 according to an applied electrical current (or voice current) based on Fleming's left hand rule. The vibration unit 530 may be expressed as a sound generating unit, a vibration generating module, a vibration generating unit, an actuator, an exciter or a transducer, but it is not limited thereto.

The vibration unit 530 may include an actuator (or exciter) disposed as to contact the rear surface of the display module 100. For example, the vibration unit 530 configured by the actuator may include a base plate 531, a magnet 532, a center pole 533, a bobbin 534, a coil 535, an edge plate 536 and a damper 537.

The base plate 531 disposed or fixed on the unit housing 510 may be a main body of the vibration unit 530. The base plate 531 may support the magnet 532, the center pole 533 and the edge plate 536. The base plate 531 may be made of a magnetic metal material such as iron (Fe). The base plate 531 may be expressed as a lower plate, a base frame or a yoke, but it is not limited thereto.

The base plate 531 may include a groove for receiving the magnet 532 and the bobbin 534. For example, the groove may be formed to be concave from the upper surface of the base plate 531 to have a circular shape.

Even though not shown in drawings, the base plate 531 may be fixed to the unit housing 510 with a fixing element or be made as one body with the unit housing 510. The fixing element may be an adhesive element. For example, the adhesive element may be an adhesive or a double-side tape, but it is not limited thereto.

In another example, the fixing element may include a screw. The screw may penetrate the base plate 531 to fasten with the unit housing 510. In other example, the fixing element may include a bolt and a nut. The nut may be installed or fixed on the unit housing 510 overlapped with the base plate 531. The bolt may penetrate the base plate 531 to be joined with the nut. In one example, the nut may be a self-clinching nut disposed at the unit housing 510. The self-clinching nut may be a PEM nut.

The magnet 532, the center pole 533, the bobbin 534 and the coil 535 may be expressed as a magnetic circuit unit or a self-vibration unit installed in the base plate 531 for vibrating the display module 100.

In one example, the magnetic circuit unit may have a structure of an external magnetic type or a dynamic type in which the magnet 532 is disposed outside the coil 535, or an internal magnetic type or a micro-type in which the magnet 532 is disposed inside the coil 535. The vibration unit 530 including a magnetic circuit unit of internal magnetic type may have an advantage that a leakage magnetic flux is small and has a small overall size. The vibration unit 530 according to the present disclosure may have a structure of an external type or internal type, and the following description mainly focuses on the structure of the internal type.

In one example, the magnet 532 may be inserted into the groove of the base plate 531. The magnet 532 may be permanent magnet having a cylindrical shape that can be inserted into the bobbin 534. In one example, the magnet 532 may include a sintered magnet such as the barium ferrite, and the material may include at least any one of ferrous trioxide ($Fe_2O_3$), barium carbonate ($BaCO_3$), neodymium magnets, magnetically enhanced strontium ferrite ($Fe_{12}O_{19}Sr$), aluminum (Al), nickel (Ni) and cobalt (Co) or alloy casting magnets of them. For example, the neodium magnet may be meodium-iron-boron (Nd—F—B), but it is not limited thereto.

In one example, the bobbin 534 may be disposed on the base plate 531 as surrounding the magnet 532. The bobbin 532 may have a circular shape or oval shape, but it is not limited thereto. The oval shape may include an elliptical shape, a rectangular shape with rounded corners, or non-circular cured shape having a width different from its height, but it is not limited thereto. For example, in the oval shaped bobbin 534, the ratio of the major axis to the minor axis may be configured as 1.3:1 to 2:1. The oval-shaped bobbin 534 may improve the sound of a high-pitched tone bandwidth than the circular shaped bobbin, and has less heat generation due to vibration, and thus may have excellent heat dissipation characteristics.

In one example, the coil 535 may be wounded to surround the outer circumferential surface of the bobbin 534 to receive the electrical current (or voice current) for sound generation from the outside. The coil 535 may be lifted together with the bobbin 534. The coil 535 may be expressed by a voice coil. When a current is applied to the coil 535, the entire bobbin 534 moves up and down according to Fleming's left-hand rule based on the applied magnetic field formed around the coil 535 and the external magnetic field formed around the magnet 532. Then, sound PVS or sound waves may be generated by vibration of the display module 100 due to vertical movement (or oscillation, or vibration) of the bobbin 534.

In one example, as the coil 535 is wounded to surround the outer circumferential surface of the bobbin 534, the heat generated in the coil 535 may be transferred to the bobbin 534 and the heat of the bobbin 534 may affect the display panel 110. Due to this heat influence, the image quality defects may occur. In order to reduce the heat influence, the coil 535 may be made of a material having excellent heat dissipation characteristics. In addition, as the bobbin 354 vibrates up and down, a partial oscillation occurs due to the top and bottom vibrations. The partial oscillation of the bobbin 534 may be influenced by the weight of the bobbin 534, and the weight of the bobbin 534 may be influenced by the weight of the coil 535. When the weight of the coil 535 is reduced, the partial oscillation of the bobbin 534 may be reduced. Considering the heat transmitted to the bobbin 534 and the partial oscillation of the bobbin 534, the coil 535 may be made of aluminum having a better thermal conductivity than copper, which is a material of a general coil, having relatively excellent heat dissipation properties, and being relatively lighter than copper.

In addition, aluminum may form an oxide film in the air, so that the soldering is not easy when the vibration unit 530 is manufactured, so the coil 535, for example, may have an aluminum layer (or a first metal layer) for heat dissipation and a metal shell layer surrounding the aluminum layer. In this case, the metal shell layer may include any one material of copper (Cu), silver (Ag) and gold (Au). For example, the coil 535 may be a copper clad aluminum wire. As the metal shell layer may be formed in the form of a thin film on the outside of the first metal layer, the weight of the coil 535 may not be significantly affected. The coil 535 according to one example of the present disclosure may have a weight which is about 60% of the weight of the coil made of copper material or copper wire alone.

In one example, the bobbin 534 may be a structure formed of a material such as pulp or paper, aluminum or magnesium or an alloy thereof, or a synthetic resin such as polyimide. For example, the bobbin 534 may be made of polyimide film having a relatively excellent heat dissipation property and a relatively light weight, in order to prevent local image quality defects of the display panel 110 due to the heat generated from the coil 535.

The polyimide film has the excellent heat resistance, electrical insulation, flexibility and non-combustibility without changing physical properties in a wide temperature range from −273° C. to +400° C. The polyimide film has excellent thermal and mechanical strength, so it may improve the reliability of the bobbin 534. Due to excellent heat dissipation properties, the heat generated by the vibration of the bobbin 534 may be reduced. For example, the polyimide film may be made of KAPTON or a combination of pyromellitec dianhydride and 4,4'-oxydianiline.

The center pole 533 may be accepted or inserted into the bobbin 534 to guide of the up-down movement of the bobbin 534. For example, the center pole 533 may be inserted inside the bobbin 534 and the outer circumference of the center pole 533 may be surrounded by the bobbin 534. The center pole 533 may be expressed as an elevation guider or a pole pieces, but it is not limited thereto.

The edge frame 536 may be disposed at the circumference of the front surface of the base plate 531 and support the damper 537. In one example, the edge frame 536 may be formed at the circumference of the front surface of the base plate 531 with a predetermined height to have the similar shape as the bobbin 534. In another example, the edge frame 536 may be formed at the circumference of the front surface of the base plate 531 with a predetermined height and include a hollow (or cavity) having the same shape as the bobbin 534.

The damper 537 may be disposed between the edge frame 536 and the magnet circuit unit as to link therebetween. For example, the damper 537 may be disposed between the edge frame 536 and the bobbin 534. The damper 537 may be expressed as a spider, a suspension or an edge, but it is not limited thereto In one example, one end of the damper 537 may be connected to the edge frame 536 and the other end of the damper 537 may be connected to the upper outer surface of the bobbin 534. The damper 537 may be made of a corrugated structure between one end and the other end to adjust or to absorb the vibration of the bobbin 534 while shrinking and relaxing according to the vertical movement of the bobbin 534. Connecting between the bobbin 534 and the edge frame 536, the damper 537 may limit the vibration distance of the bobbin 534 by the resilient or restoring force. For example, when the bobbin 534 vibrates over or below certain distance, the bobbin 534 may return to its original position by the resilience of the damper 537.

In one example, the damper 537 may be made of a metal element electrically connected to the coil 535. For example, the damper 537 may have a spring structure made of metal material having high elasticity. For example, the damper 537 may be made of a stainless steel or copper, but it is not limited thereto.

In one example, the vibration unit 530 may further include a boobin protector 538. The bobbin protector 538 may be disposed at the upper surface (or end portion) of the bobbin 534 to transmit the elevation movement (or vibration) of the bobbin 534 to the rear surface of the display module 110. For example, the bobbin protector 538 may have a ring shape attached at the front surface of the bobbin 534, a disc shape covering the whole front surface of the bobbin 534 or a cap shape surrounding the front surface and the upper outer side surface of the bobbin 534. The bobbin protector 538 may be expressed as a bobbin ring or a bobbin upper plate, but it is not limited thereto. In other example, one end of damper 537 may be connected to the edge frame 536 or the base plate 531 and the other end of damper 537 may be connected to the bobbin protector 538.

The sound generating unit 500 according to the first embodiment of the present disclosure may be installed inside the back cover 300 and attached on the rear surface of the display module 100. In one example, the vibration unit 530 configuring the sound generating unit 500 may be attached to the rear surface of the display module 100. In this case, the adhesive element 600 may be disposed between the bobbin protector 538 of the vibration unit 530 and the display module 100.

The adhesive element 600 may be a double side tape or a double side form tape, and may include PSA (pressure sensitive adhesive), OCA (optical clear adhesive) or OCR (optical clear resin), but it is not limited thereto.

Further, in this case, the upper surface of the bobbin protector 538 in the vibration unit 530 may be extruded little bit over the top surface of the upper substrate 330 of the back cover 300. The display module 100 may be vibrated by the elevation movement of the bobbin 534, and thus the sounds are generated. In this case, only the vibration unit 530 may be attached to the display module 100, so the vibrating display module 100 may collide with the unit housing 510 or the back cover 300 causing noises. To prevent the noise, the extrusion amount of the bobbin protector 538 may be higher than the elevation movement range of the bobbin 534.

In another example, the vibration unit 530 configuring the sound generating unit 500 and the unit housing 510 may be attached at the rear surface of the display module 100. In this case, the adhesive element 600 may be disposed between the top surface of the bobbin protector 538 of the vibration unit 530 and the top surface 513 of the unit housing 510.

In still another example, the upper surface of the back cover 300 where the sound generating unit 500 is inserted and the upper surface of the sound generating unit 500 may be attached on the rear surface of the display module 100. In this case, the top surface 513 of the unit housing 510 of the sound generating unit 500, the upper surface of the bobbin protector 538 of the vibration unit 530 and the upper surface of the upper substrate 330 of the back cover 300 may be disposed on the same plane. After depositing the adhesive element 600 on the whole rear surface of the display module 100 and inserting the sound generating unit 500 into the back cover 300, the back cover 300 is attached at the adhesive element 600. As attaching to the whole rear surface of the display module 100, the back cover 300 may play role of protecting the rear surface of the display module 100 and of dissipating the heat generated from the display module 100 to out environment.

In the case that the vibration unit 530 and the unit housing 510 are attached to the display module 100 using the adhesive element 600 according to the first embodiment, it is preferable that the area of the opening provided in the top surface 513 of the unit housing 510 is sufficiently ensured to provide a vibration space surrounding the vibration unit 530 between the unit housing 510 and the display module 100. The vibration space may be expressed as a sound pressure space, an echo box, an echo section, a resonance box or a resonance section, but it is not limited thereto.

The display apparatus according to the present disclosure may include at least one sound generating module disposed at the center portion (or middle area) on the rear surface of the display module 100. For example, one sound generating module may vibrate the center portion of the rear surface of the display module 100 so the sounds PVS by the vibration of the display module 100 may be provided.

In another example, the display apparatus may include a first sound generating unit and a second sound generating unit, wherein the first sound generating unit may be disposed at a first area (or left area) of the display module 100 with respect to the center of the display module 100, and the second sound generating until may be disposed at a second area (or right area) of the display module 100. For example, the first sound generating unit may vibrate a first rear area of the display module 100 to provide the sounds PVS by the vibration of the first rear area of the display module 100. The second sound generating unit may vibrate a second rear area of the display module 100 to provide the sounds PVS by the vibration of the second rear area of the display module 100. In this case, the display apparatus may provide the stereo sounds of 2-channel according to the separation of sounds into left and right components through the first and second sound generating units. The first sound generating unit may be configured to output the left sounds and the second sound generating unit may be configured to output the right sounds.

In one example, at least one sound generating unit 500 may be installed inside the back cover 300 to vibrate the display module 100 and output the sounds PVS. As surrounded by the back cover 300, the sound generating unit 500 may be concealed without being exposed to the outermost rear part of the display apparatus. Accordingly, the display apparatus according to the present disclosure may have a clean back design in which the sound generating unit 500 is not shown by users, and the rear outer design may be improved.

At least one sound generating unit 500 according to one example may be one body structure or single body modulized as one instrument part. For example, after being manufactured in the form of a finished product such as one body structure or a single body by a modular process (or an pre-assembly process), at least one sound generating unit 500 may be mounted or placed inside a compartment 370 of the rear cover 300 by a relatively simple component mounting (or placement) process in the assembly process of the display apparatus. Therefore, according to the present disclosure may improve the production yield of the display apparatus, because of enhanced the assembly efficiency of the sound generating unit 500.

Second Embodiment

Figure 4:
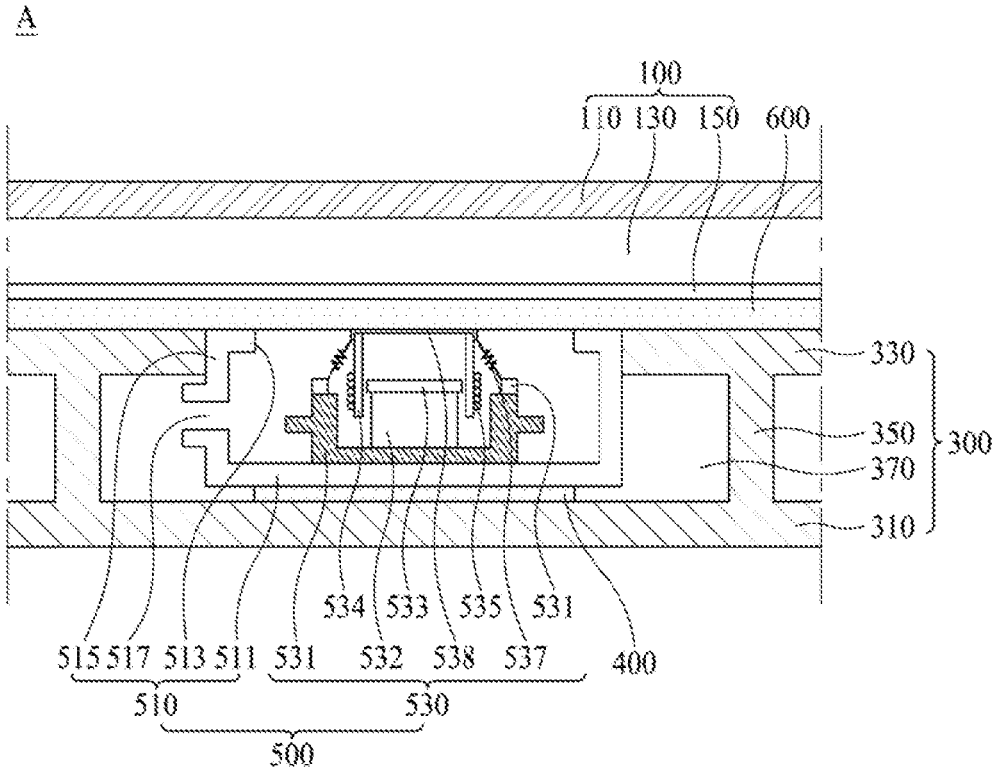
FIG. 4 is an enlarged cross-sectional view illustrating a structure of a display apparatus according to the second embodiment of the present disclosure.

FIG. 4 is an enlarged cross-sectional view illustrating a structure of a display apparatus according to the second embodiment of the present disclosure. The display apparatus according to the second embodiment of the present disclosure may have the similar structure with the first embodiment. The difference is that the second embodiment may further include a resonance opening or resonance path 571 connecting the inner space of the unit housing 510 and the space of compartment 370 formed in the back cover 300.

Referring to FIG. 4, the display apparatus according to the second embodiment of the present disclosure may comprise a display module 100, a back cover 300 and a sound generating unit 500. The sound generating unit 500 may have a structure for embedding into the back cover 300 and fixed thereto. The display module 100 may be same as that of the first embodiment, so same explanation will not be duplicated.

The detailed structure of the back cover 300 may be same as that of the first embodiment, so same explanation will not be duplicated. When it is necessary, further explanation is made by referring the first embodiment explanation.

The sound generating unit 500 may be inserted and fixed into a compartment 370 formed at the back cover 300. The sound generating unit 500 may include a unit housing 510 and a vibration unit 530. The vibration unit 530 may flexed inside the inner space of the unit housing 510. Therefore, the unit housing 510 may have sufficient volume to enclosing the vibration unit 530. The detail structure of the vibration unit 530 may be very similar with that of the first embodiment, so duplicated explanation will be omitted.

The unit housing 510 may include a bottom surface 511, a top surface 513, a side surface 515 and a resonance opening 517. The bottom surface 511 may be a bottom plate of the unit housing 510 for fixing or installing the vibration unit 530 thereon. In addition, the bottom surface 511 may be fixed inside the back cover 300. The top surface 513 may be a top plate facing the bottom surface 511 with a predetermined distance. The top surface 513 may have an aperture. Through this aperture, the vibration unit 530 may be installed on or disassembled from the bottom surface 511. The side surface 515 may be a side plate for connecting the bottom surface 511 and the top surface 513 for protecting the inner space of the unit housing 510.

The resonance opening 517 may be a structure formed at the side surface 515 for connecting the inner space of the unit housing 510 and the space of compartment, so it may be expressed as a resonance pathway. As the vibration unit 530 makes a vibration movement in the unit housing 510, the display module 100 may be vibrated by the bobbin 534 or the bobbin protector 538 attached at the rear surface of the display module 100. The vibration of the display panel 100 may provide the sound pressure to the air occupied in the space of the unit housing 510. Accordingly, a rich volume of sound may be provided by the resonance occurred inside of the unit housing 510.

The circumference of the unit housing 510 may be surrounded by the partition wall 350 of the back cover 300. That is, the unit housing 510 may be enclosed by the inner space of the compartment 370 defined by the partition wall 350. Therefore, the sounds vibrated inner space of the unit housing 510 may be resonated with the inner space of the compartment 370, so that further richer sounds may be provided.

The display apparatus according to the second embodiment of the present disclosure may further include the resonance opening 517 having a predetermined size at one portion of the side surface 515 of the unit housing 510. Adjusting the position, the diameter and/or the length of the resonance opening 517, the sound pressure of the desired bandwidth may be enhanced or controlled.

In one example, applying Helm Hotz resonator theory, the resonance opening 517 may control the sound pressure of any desired bandwidth. For example, high sound quality may be acquired by selectively enhancing the sound pressure in the high-frequency bandwidth range.

For example, the formula for obtaining resonant frequency by Helm-Holz resonator theory may be as shown in Equation 1 below.

$$f = 5410\sqrt{\frac{a}{V(l+0.8D)}}\ (\text{cm/sec}) \qquad \text{[Equation 1]}$$

Figure 5:
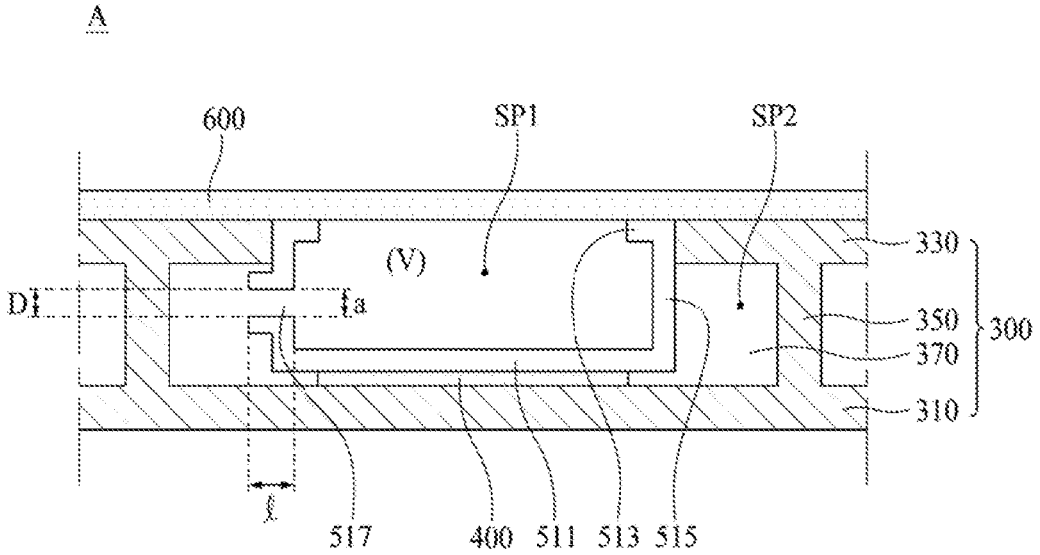
FIG. 5 is a cross-sectional view illustrating a structure in which a unit housing having a resonance opening is inserted inside the back cover of the display apparatus according to the second embodiment of the present disclosure.

Here, 'f' refers to the resonant frequency, 'V' refers to the volume (cm3) of the space (in the unit housing 510), 'a' refers the cross-sectional area (cm2) of the resonance opening, 'D' refers to a diameter (cm) of the resonance opening, and 'l' refers to the protruding length (cm) of the resonance opening 517. The names of the parts may be referred to FIG. 5. FIG. 5 is a cross-sectional view illustrating a structure in which a unit housing having a resonance opening is inserted inside the back cover of the display apparatus according to the second embodiment of the present disclosure.

Even though an aperture is formed at the top surface 513 of the unit housing 510, this aperture is closed as the unit housing 510 is attached to the display module 100 using the adhesive element 600. Therefore, the unit housing 510 has a closed unit housing space SP1. In addition the unit housing 510 is surrounded by the partition walls 350 of the back cover 300 so as that the compartment 370 is also formed as the closed compartment space SP2. In this case, adjusting the resonance opening 517 with the unit housing 510 referring to Equation 1, the sound pressure of a desired sound frequency bandwidth may be improved or enhanced.

In another case, the upper substrate 330 of the back cover 300 may be separated from the unit housing 510 by a gap, so that the adhesive element 600 may not be applied to the upper surface of the back cover 300 and may not be attached to the display module 100. In this case, the compartment space SP2 may not be closed but form an open space.

Third Embodiment

Figure 6:
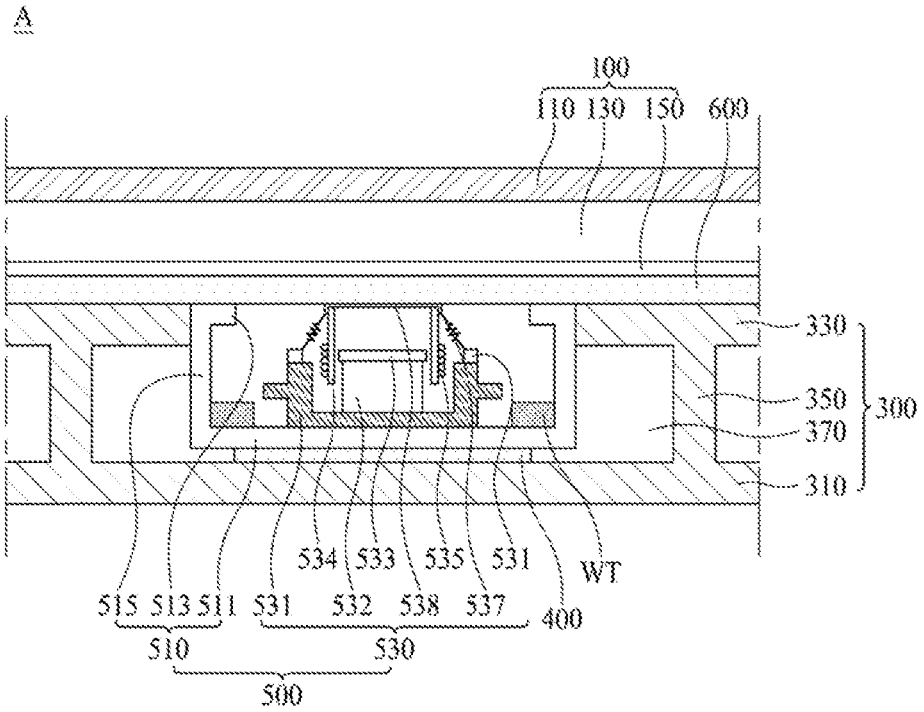
FIG. 6 is an enlarged cross-sectional view illustrating a structure of a display apparatus according to the third embodiment of the present disclosure.

Hereinafter, referring to FIG. 6, the third embodiment of the present disclosure will be explained. FIG. 6 is an enlarged cross-sectional view illustrating a structure of a display apparatus according to the third embodiment of the present disclosure. The display apparatus according to the third embodiment may have the similar structure with that of the first embodiment. The difference is that the display apparatus according to the third embodiment may further include a weight element WT in the inner space of the unit housing 510.

Referring to FIG. 6, the display apparatus according to the third embodiment of the present disclosure may comprise a display module 100, a back cover 300 and a sound generating unit 500. The sound generating unit 500 may have a structure of being inserted and fixed into the back cover 300. With the same structure with the first embodiment, the detailed explanation about the display module 100 will not be duplicated.

The detailed structure of the back cover 300 is also very similar with the first embodiment, same explanation will not be duplicated. When it is necessary, the description of the first embodiment may be recited to further explain.

The sound generating unit 500 may be inserted and fixed into the compartment 370 formed at the back cover 300. The sound generating unit 500 may include a unit housing 510 and a vibration unit 530. The vibration unit 530 may be fixed inner space of the unit housing 510. Therefore, the unit housing 510 may have sufficient volume for enclosing or mounting the vibration unit 530. The detailed structure of the vibration unit 530 may be very similar with the first embodiment, so the duplicated explain will be omitted.

The unit housing 510 may include a bottom surface 511, a top surface 513 and a side surface 515. The bottom surface 511 may be a bottom plate of the unit housing 510 for fixing or installing the vibration unit 530 thereon. In addition, the bottom surface 511 may be fixed inside the back cover 300. The top surface 513 may be a top plate facing the bottom surface 511 with a predetermined distance. The top surface 513 may have an aperture. Through this aperture, the vibration unit 530 may be installed on or disassembled from the bottom surface 511. The side surface 515 may be a side plate for connecting the bottom surface 511 and the top surface 513 for protecting the inner space of the unit housing 510.

The weight element WT may be disposed and fixed inside the unit housing 510. In one example, the weight element WT may be disposed as a ring shape along the circumference of the bottom surface 511. In another example, the weight element WT may be disposed as a ring shape at the side surface 515. In still another example, the weight element WT may be implemented as a nut shape at the center portion of the bottom surface 511, and the base plate 531 of the vibration unit 530 may be screwed and tightened to the nut. When necessary, the weight element WT may be disposed at the corner portion where the top surface 513 meets the side surface 515 in the unit housing.

The weight element WT may increase the total weight of the unit housing 510. As the vibration unit 530 fixed to the unit housing 510 vibrates the display module 100, the movement of the vibration unit 530 may be generated from the elevation movement of the bobbin 534. The momentum of the elevation movement of the bobbin 534 may be decided with respect to the base plate 531. Since the base plate 531 is fixed to the unit housing 510, the momentum of the elevation movement of the bobbin 534 may be decided with respect to the unit housing 510.

In order to accurately maintain the movement of the bobbin 534, it is preferable for a base element of the movement to maintain in a relatively fixed state. That is, it is preferable that the unit housing 510 or the base plate 531 is configured to maintain in a relatively fixed state with respect to the bobbin 534, which is advantageous for ensuring good sound quality. As further including the weight element WT inside the unit housing 510, the third embodiment provides the configuration in which the unit housing 510 may be maintained in a relatively fixed state with respect to the bobbin 534.

FIG. 6 illustrates a case in which the unit housing 510 does not include the resonance opening 517. However, in the case that the resonance opening 517 is included as shown in FIG. 4 or 5, the weight element WT may be further applied. In this case, the position of the weight element WT may be arranged at any position inside the unit housing 510, as described above, as long as the resonance opening 517 is not blocked.

Figure 7:
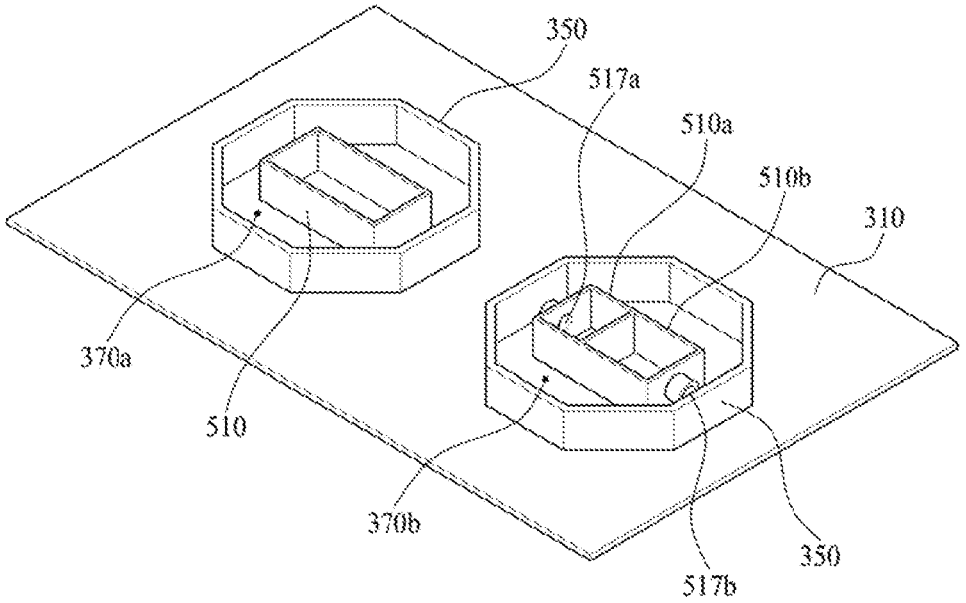
FIG. 7 is a perspective view illustrating one example of a shape of a chamber and a unit housing installed in the chamber, according to the present disclosure.

Hereinafter, referring to FIG. 7, the compartment 370 and the unit housing 510 mounted on the compartment 370 will be explained in one example of the display apparatus according to the present disclosure. FIG. 7 is a perspective view illustrating one example of a shape of a chamber and a unit housing installed in the chamber, according to the present disclosure. The specific shape and structure of the display apparatus according to the present disclosure may be not limited to FIG. 7 and may include all structures and shapes that can be modified with reference to this. In addition, the shape and structure of the compartment 370 and the unit housing 510 according to FIG. 7 may be applied to all the embodiments described above.

Referring to FIG. 7, tin the display apparatus according to the present disclosure, the back cover 300 may include a lower substrate 310 and a plurality of partition walls 350 disposed on the lower substrate 310. Further, an upper substrate 330 may be disposed on the partition wall 350, but it is not shown in convenience of explanation. In addition, although the partition walls may be continuously arranged on the whole surface of the lower substrate 310, for convenience of explanation, sets of partition walls 350 forming compartments 370 are illustrated in FIG. 7.

By the plurality of partition walls 350, a plurality of compartments 370*a* and 370*b* may be defined. Here, the compartments 370*a* and 370*b* are illustrated as having a regular octagon shape. However, it is not limited thereto but have various polygon shapes.

The unit housing 510 may be installed and fixed inside each of the compartments 370*a* and 370*b*. Like the left compartment 370*a* shown in FIG. 7, each compartment may have one unit housing 510. In some cases, like the right compartment 370*b* shown in FIG. 7, one compartment may have at least two unit housings 510*a* and 510*b*.

When including at least two unit housing 510*a* and 510*b* in one compartment, they may be arranged spaced with certain distance from each other, but they may be arranged in close contact with each other. Each of unit housings 510*a* and 510*b* may have one vibration unit (not shown in figure), respectively. In this case, each of vibration units (not shown) may be vibration devices those generate sound vibrations of different frequency bandwidths each other.

In one example, the unit housing 510 may have the same shape with the compartment 370. Otherwise they may have different shape each other. FIG. 7 illustrates that the unit housing 510 has a rectangular shape different from the shape of compartment 370. However, it is not limited thereto, but has various shapes.

In one example, the unit housing 510 may further include a resonance opening 518. As shown in FIG. 7, each of two unit housings 510*a* and 510*b* may have one resonance opening, respectively. For example, a first resonance opening 517*a* may be provided in the first unit housing 510*a* in which a vibration unit (not shown) generating a high frequency bandwidth sound may be installed. Further, a second resonance opening 517*b* may be provided in the second unit housing 510*b* in which a vibration unit (not shown) generating a low frequency bandwidth sound may be installed.

The size of each part may be determined with reference to Equation 1 so that the first unit housing 510*a* and the first resonance opening 517*a* may be satisfied with a condition capable of resonating with respect to the frequency of the treble bandwidths. As well, the size of each part may be determined with reference to Equation 1 so that the second unit housing 510*b* and the second resonance opening 517*b* may be satisfied with a condition capable of resonating with respect to the frequency of the bass bandwidths.

As shown in FIG. 7, the direction of the resonance openings 517*a* and 517*b* may be faced in opposite directions to each other. However, it is not limited thereto. They may be arranged in a "V" shape or "11" shape.

Figure 8:
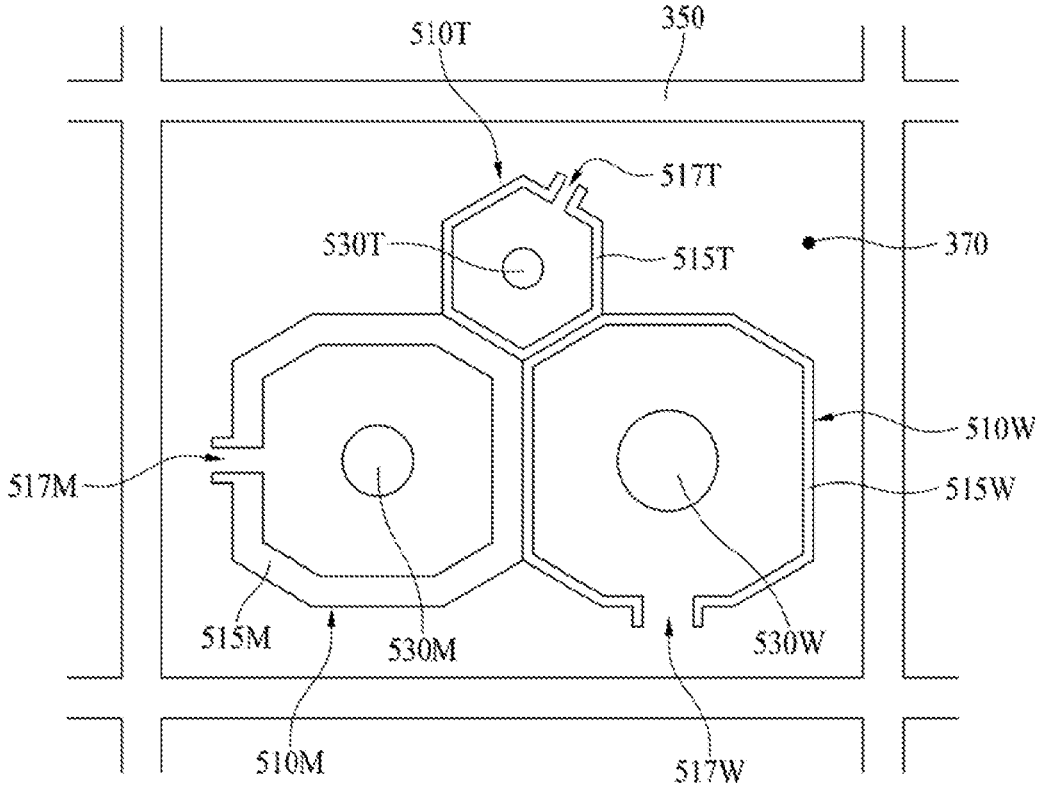
FIG. 8 is a plane view illustrating one example of a shape of a chamber and a unit housing installed in the chamber, according to the present disclosure.

Hereinafter, referring to FIG. 8, the compartment 370 and the unit housing 510 mounted on the compartment 370 will be explained in another example of the display apparatus according to the present disclosure. FIG. 8 is a plane view illustrating one example of a shape of a chamber and a unit housing installed in the chamber, according to the present disclosure. As the structure of the unit housing provided in the compartment may be more complicated than the examples described above, FIG. 8 illustrates a plane view for convenience of understanding. The reference numerals that do not appear in the drawings may refer to the numerals in the preceding drawings.

The specific shape and structure of the display apparatus according to the present disclosure may be not limited to FIG. 8 and may include all structures and shapes that can be modified with reference to this. In addition, the shape and structure of the compartment 370 and the unit housing 510 according to FIG. 8 may be applied to all the embodiments described above.

Referring to FIG. 8, tin the display apparatus according to the present disclosure, the back cover 300 may include a lower substrate 310 and a plurality of partition walls 350 disposed on the lower substrate 310. Further, an upper substrate 330 may be disposed on the partition wall 350, but it is not shown in convenience of explanation. In addition, although the partition walls may be continuously arranged on the whole surface of the lower substrate 310, for convenience of explanation, sets of partition walls 350 forming compartments 370 are illustrated in FIG. 8.

The compartment 370 may be defined as a space surrounded by the partition walls 350. Here, in convenience, the compartment 370 is illustrated as a rectangular shape in a plan view. However, it is not limited thereto, but it may have any shape including various polygon, circle or ellipse.

Inside of the compartment 370, at least one unit housing 510 may be disposed. In FIG. 8, three unit housings 510 are disposed. In detail, a treble unit housing 510T for high frequency bandwidth sound, a mid unit housing 510M for middle frequency bandwidth sound and a bass unit housing 510W for low frequency bandwidth sound may be included. However, it is not limited thereto, but more sub unit housings may be further included.

The treble unit housing 510T may include a treble bottom surface (not shown), a treble top surface (not shown), a treble side surface 515T and a treble resonance opening 517T. As FIG. 8 illustrates a plan view, it shows the treble side surface 515T and the treble resonance opening 517T. The treble side surface 515T may have a first thickness. Considering the volume of the treble unit housing 510T, the treble resonance opening 517T may have a cross-sectional area, a diameter and a protrusion length defined by Equation 1. The treble resonance opening 517T may link the compartment 370 to the inner space of the treble unit housing 510T. In the inner space of the treble unit housing 510T, a treble vibration unit 530T may be disposed.

The mid unit housing 510M may include a mid bottom surface (not shown), a mid top surface (not shown), a mid side surface 515M and a mid resonance opening 517M. As FIG. 8 illustrates a plan view, it shows the mid side surface 515M and the mid resonance opening 517M. The mid side surface 515M may have a second thickness. Considering the volume of the mid unit housing 510M, the mid resonance opening 517M may have a cross-sectional area, a diameter and a protrusion length defined by Equation 1. The mid resonance opening 517M may link the compartment 370 to the inner space of the mid unit housing 510M. In the inner space of the mid unit housing 510M, a mid vibration unit 530M may be disposed.

The bass unit housing 510W may include a bass bottom surface (not shown), a bass top surface (not shown), a bass side surface 515W and a bass resonance opening 517W. As FIG. 8 illustrates a plan view, it shows the bass side surface 515W and the bass resonance opening 517W. The bass side surface 515W may have a third thickness. Considering the volume of the bass unit housing 510W, the bass resonance opening 517W may have a cross-sectional area, a diameter and a protrusion length defined by Equation 1. The bass resonance opening 517W may link the compartment 370 to the inner space of the bass unit housing 510W. In the inner space of the wofr unit housing 510W, a bass vibration unit 530W may be disposed.

In FIG. 8, the treble unit housing 510T may have the smallest inner space, the bass unit housing 510W may have the largest inner space and the mid unit housing 510M may have a medium inner space. This is an example in which the frequency bandwidth is designed in consideration of having characteristics of high, medium and low depending on the size of the vibration space, each unit housing.

For easiness of design, the bass unit housing 510W and the mid unit housing 510M may have the same shape and outer size. In order to have different volume of the inner space, the second thickness of the mid side surface 515M of the mid unit housing 510M may be thickener than the third thickness of the bass side surface 515W of the bass unit housing 510W. The first thickness of the treble side surface 515T of the treble unit housing 501T may be same with any one of the second thickness and the third thickness. Adjusting the first to third thicknesses, it is freely designing the inner spaces of the treble unit housing 510T, the mid unit housing 510M and the bass unit housing 510W, respectively.

As the treble resonance opening 517T, the mide resonance opening 517M and the bass resonance opening 517W may be calculated by Equation 1, they may have different space, respectively. Further, the directions of each resonance openings 517T, 517M and 517W may be differently arranged. For example, as shown in FIG. 8, they may be facing different directions, respectively. For another example, they may be disposed as having 120 degrees between each direction of the resonance openings.

The treble vibration unit 530T may generate a sound vibration having high frequency bandwidth. The mid vibration unit 530M may generate a sound vibration having middle frequency bandwidth. The bass vibration unit 530W may generate a sound vibration having low frequency bandwidth. The treble vibration unit 530T may have the smallest size, and the bass vibration unit 530W may have the largest size. Further, the mid vibration unit 530M may have a middle size between the treble vibration unit 530T and the bass vibration unit 530W.

In addition, the compartment 370 surrounding the treble unit housing 510T, the mid unit housing 510M and the bass unit housing 510W may have various shapes by taking into account the interaction with each resonance openings 517T, 517M and 517W. Although having a simple square shape as shown in FIG. 8, the compartment 370 may be formed in various shapes such as an oval shape and a cloud shape for adjusting the efficiency of each of the resonance openings 517T, 517M and 517W.

Features, structures, effects and so on described in the above described examples of the present disclosure are included in at least one example of the present disclosure, and are not necessarily limited to only one example. Furthermore, features, structures, effects and so on exemplified in at least one example of the present disclosure may be implemented by combining or modifying other examples by a person having ordinary skilled in this field. Therefore, contents related to such combinations and modifications should be interpreted as being included in the scope of the present application.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display apparatus comprising:
- a display module;
- a back cover disposed at a rear surface of the display module;
- a compartment provided inside the back cover;
- a fixing element provided inside the compartment;
- a sound generating unit inserted into the compartment and installed by the fixing element; and
- an adhesive element attaching an upper surface of the sound generating unit and the rear surface of the display module,
- wherein the back cover includes:
  - an upper substrate facing to the rear surface of the display module;
  - a lower substrate apart from the upper substrate with a predetermined distance; and
  - a plurality of partition walls disposed between the upper substrate and the lower substrate,
- wherein the compartment is defined by the upper substrate, the lower substrates and at least one partition wall, and
- wherein a bottom surface of the compartment is joined with bottom of the sound generating unit by the fixing element.

2. The apparatus according to claim 1, wherein the sound generating unit is inserted into the compartment from a top surface of the compartment.

3. The apparatus according to claim 2, wherein the sound generating unit include:
- a unit housing; and
- a vibration unit mounted inside the unit housing, and
- wherein an upper surface of the vibration unit is attached to the rear surface of the display module by the adhesive element.

4. The apparatus according to claim 3, further comprising:
- a resonance path connecting an inner space of the unit housing and the compartment.

5. The apparatus according to claim 3, further comprising:
- a weight element attached inside the unit housing.

6. The apparatus according to claim 3, wherein the adhesive element is formed overall of the rear surface of the display module, and
- an upper surface of the unit housing, an upper surface of the vibration unit and a top surface of the upper substrate of the back cover are attached to the display module by the adhesive element.

7. The apparatus according to claim 3, wherein an upper surface of the unit housing is disposed at a same level with or at higher level from an upper surface of the upper substrate, and
- wherein the adhesive element is deposited on the upper surface of the unit housing and the upper surface of the vibration unit.

8. A display apparatus comprising:
- a sound generating unit including a vibration unit installed in a unit housing;
- a back cover including a compartment where the sound generating unit is inserted, and a fixing element provided inside the compartment; and
- a display module disposed at a top surface of the back cover and attached to an upper surface of the vibration unit,
- wherein the back cover includes:
  - an upper substrate;
  - a lower substrate facing the upper substrate with a predetermined distance; and
  - a plurality of partition walls disposed between the upper substrate and the lower substrate,
- wherein the compartment is defined by the upper substrate, the lower substrate and at least one partition wall, wherein the sound generating unit inserted in the compartment through a mounting hole formed by removing some of the upper substrate, and wherein the sound generating unit is installed at the lower substrate by the fixing element.

9. The apparatus according to claim 8, wherein the display module includes:

a display panel including a display area and a non-display area surrounding the display area;

a functional film disposed at an outer upper surface of the display panel; and a heat dissipate element disposed at a rear surface of the display panel, and wherein further comprising:

an adhesive element attaching the upper surface of the vibration unit to the heat dissipate element.

10. The apparatus according to claim 8, further comprising:

a guide panel surrounding sides of the back cover and the display module, and assembling the back cover with the display module.

11. The apparatus according to claim 8, wherein the sound generating unit further includes:

a weight element installed at circumference of the vibration unit inside the unit housing.

12. The apparatus according to claim 8, wherein the unit housing includes:

a bottom surface;

a top surface facing the bottom surface and having an aperture; and a side surface connecting the bottom surface and the top surface, and wherein the vibration unit is installed on the bottom surface.

13. The apparatus according to claim 12, wherein the unit housing further includes:

a resonance opening formed at one portion of the side surface for exposing an inner space of the unit housing.

14. The apparatus according to claim 8, wherein the vibration unit includes:

a base plate having vessel shape and fixed inside the unit housing;

a magnet having a cylindrical shape and fixed at a center portion of the base plate;

a bobbin apart from the magnet and surrounding the magnet;

a coil surrounding the outer circumference of the bobbin;

a bobbin protector attached at the upper portion of the bobbin; and a damper connecting at least one of the bobbin and the bobbin protector to the base plate, and wherein an upper surface of the bobbin protector is attached to the display module.

15. The apparatus according to claim 5, wherein the compartment has any one shape, in a plan view, of a square, a rectangle, a regular hexagon, a regular octagon, a circle and an oval.

16. The apparatus according to claim 5, further comprising:

a resonance path connecting an inner space of the unit housing and a space of the compartment.

* * * * *